US005655678A

United States Patent [19]

Kobayashi

[11] Patent Number: 5,655,678

[45] Date of Patent: Aug. 12, 1997

[54] CONTAINER OPENING DEVICE WITH BEND-SUPPORTING PORTION

[76] Inventor: Tadao Kobayashi, 1-9-11, Higashi-Ikuta, Tama-ku, Kawasaki-shi 214, Japan

[21] Appl. No.: 392,173

[22] Filed: Feb. 22, 1995

[30] Foreign Application Priority Data

Feb. 25, 1994 [JP] Japan ..... 6-066395
Dec. 28, 1994 [JP] Japan ..... 6-340946

[51] Int. Cl.[6] ..... B65D 17/34

[52] U.S. Cl. ..... 220/269; 220/270; 220/906

[58] Field of Search ..... 220/269, 270, 220/272, 273, 906

[56] References Cited

U.S. PATENT DOCUMENTS

| | | | |
|---|---|---|---|
| 3,894,653 | 7/1975 | Ostrem | 220/273 |
| 4,367,996 | 1/1983 | Saunders | 220/270 X |
| 4,988,013 | 1/1991 | Kobayashi et al. | 220/270 X |
| 5,007,554 | 4/1991 | Hannon et al. | 220/269 |
| 5,131,555 | 7/1992 | DeMars et al. | 220/269 |
| 5,224,618 | 7/1993 | Garbiso | 220/269 |
| 5,385,254 | 1/1995 | Hannon | 270/270 X |

FOREIGN PATENT DOCUMENTS

| | | | |
|---|---|---|---|
| 482776 | 4/1992 | European Pat. Off. | 220/269 |
| 2016513 | 10/1971 | Germany | 220/273 |
| 4044950 | 2/1992 | Japan | 220/269 |
| 5305945 | 11/1993 | Japan | 220/270 |

*Primary Examiner*—Allan N. Shoap
*Assistant Examiner*—Nathan Newhouse
*Attorney, Agent, or Firm*—Oblon, Spivak, McClelland, Maier & Neustadt, P.C.

[57] ABSTRACT

A device for opening an opening portion of an upper panel of a container is formed of a lifting portion, a pressing portion integrally formed with the lifting portion, and an elongated portion extending from one of the lifting portion and the pressing portion. A fixing member fixes a part of the elongated portion to the upper panel of the container. In the invention, a bend-supporting portion is provided in the elongated portion between the fixing member and an edge near the one of the lifting portion and the pressing portion. When the lifting portion is pulled upwardly, the bend-supporting portion initially receives a force and bends thereat to provide a space for a finger between the upper panel and the lifting portion without substantially applying the force to the pressing portion. The opening portion for the container can be easily opening.

3 Claims, 7 Drawing Sheets

CONTAINER OPENING DEVICE WITH BEND-SUPPORTING PORTION

BACKGROUND OF THE INVENTION AND RELATED ART STATEMENT

The present invention relates to a container opening device with a bend-supporting portion, more particularly an improved tab which can stably and easily open an opening portion or a lid of a container, such as a can, by a small lifting force required for opening the opening portion or the lid at an early stage.

DISCUSSION OF THE BACKGROUND

In a conventional container opening device as shown in FIG. 13, a tab W is fixed to a lid or a cover of a can by fixing means R, such as a rivet. Edge portions S of a notch provided around the rivet R and a part of a peripheral edge, i.e. left side, of the fixing means R near the edge portions S are substantially disposed in a straight line T.

In order to easily enter a finger tip under a tip portion of a lifting portion K, the tip portion of the lifting portion K of the tab W may be curved to form a narrow space between the tip portion and the outer surface of the lid, or a shallow depression may be formed on the outer surface under the lifting portion K (both not shown).

However, in the above-described container opening device, as shown in FIG. 13, the edge portions S of the notch around the rivet R and the part of the peripheral edge, i.e. left side, of the rivet R are substantially arranged in the line T. Thus, when the finger tip engages the lifting portion K to open an opening portion U, a pressing portion N of the tab W abuts against the opening portion U of the can, and a lifting force is directly applied thereto. FIG. 14(*a*) shows a condition when the tab W is pulled, and FIG. 14(*b*) shows that the lifting portion K is pulled up.

Therefore, the initial lifting force at the lifting portion K starts working as an opening force to the opening portion U of the cover, so that a large force is required from the early stage for lifting the tab W. Accordingly, it is difficult to lift the lifting portion K of the tab by engaging the finger tip with the tab at the early stage.

Since a large force is required at the time of lifting the tab, there have been safety problems such that the finger tip may be injured, or a nail may be broken at the early stage of lifting the tab.

Also, since the edge portions of the notch around the rivet are aligned with the left-side peripheral edge of a head of the rivet in the line T, a force for lifting the tab changes its direction at the rivet as a center and is transmitted to the pressing portion of the tab to thereby press and shear the opening portion or cover. Thus, there has been another problem that a large force is required to open the opening portion or cover.

SUMMARY OF THE INVENTION

The present invention has been made in view of the above drawbacks, and an object of the invention is to provide a container opening device capable of stably and easily opening an opening portion of a container.

Another object of the invention is to provide a container opening device as stated above, wherein a finger tip can be easily slid into a space between an outer surface of a container and a lifting portion.

A further object of the present invention is to provide a container opening device, which can be easily and economically manufactured.

A container opening device of the invention comprises a tab fixed on a cover, lid or panel of a container, such as a can, by fixing means in a form of rivet. The tab includes a lifting portion located on one side, a pressing portion located on the other side thereof, and a partially detached or elongated portion extending from the lifting portion or the pressing portion. The fixing means is formed between the partially detached portion and the cover. A bend-supporting portion is formed adjacent the fixing means in the partially detached portion. Also, edge portions are formed near the partially detached portion.

In the invention, when the tab is pulled, a force required for lifting is separated into a force necessary for lifting the tab and a force necessary for opening an opening portion of the cover. The length of the pressing portion is longer than that of the bend-supporting portion which constitutes a supporting point of a lever or tab, and the bend-supporting portion is provided between the pressing portion and the fixing means.

When a finger tip is inserted into a space between the lifting portion and a surface of the cover of the container, edges of the bend-supporting portion, i.e. an edge portion on a side of the fixing means and a starting edge of the partially detached portion, are gradually bent, so that the bend-supporting portion orients upwardly. The tab fixed to the cover by the fixing means through the bend-supporting portion is lifted to thereby complete an initial lifting operation of the tab. Namely, the lifting force required for an initial lifting operation of the tab is separated from a force required for an opening operation of the cover of the container. Thus, with only the force required for bending the bend-supporting portion, the finger tip can be smoothly inserted into the space between the lifting portion and the cover surface.

Further, when the lifting portion is pulled upwardly, since the pressing portion is longer than the bend-supporting portion, the edge of the bend-supporting portion acts as a supporting point of a lever or tab, so that the lifting force at the lifting portion is transmitted to an edge of the pressing portion as an extremely large shearing force, and the cover is sheared along a score line to open the can with a very little lifting force.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
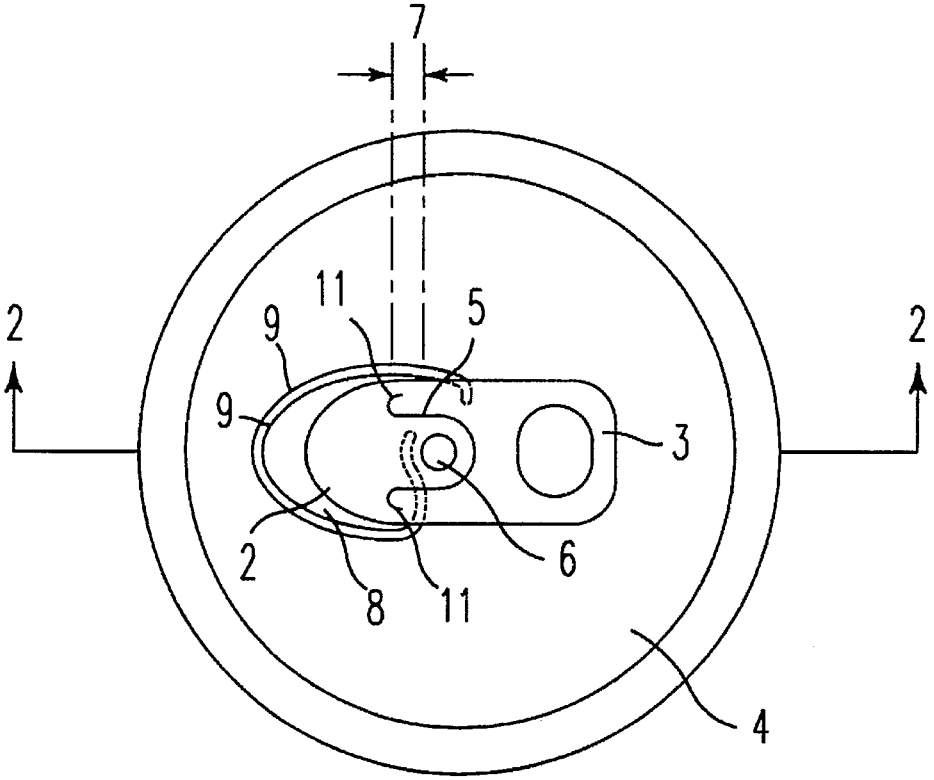
FIG. 1 is a plan view of a first embodiment of a container opening device according to the present invention.
Figure 2:
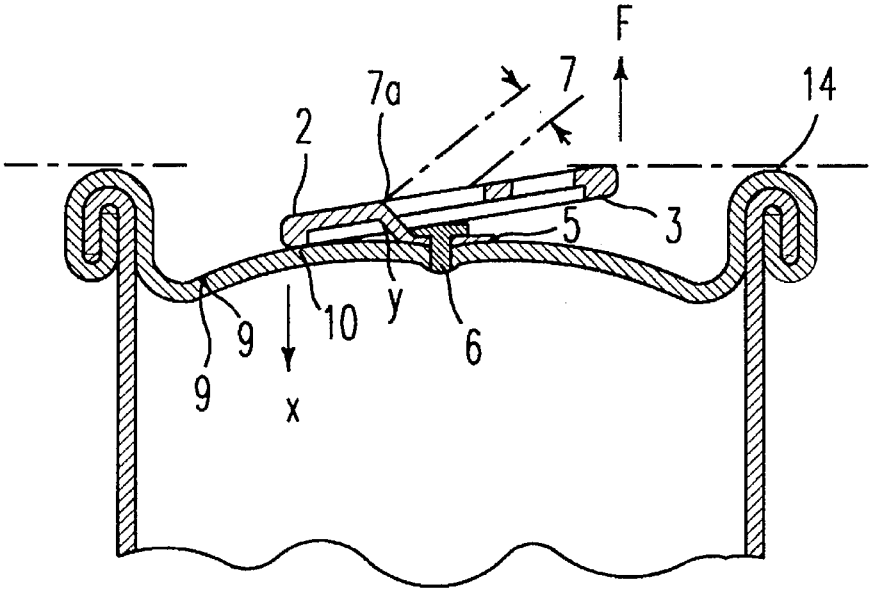
FIG. 2 is a section view taken along a line 2—2 in FIG. 1 for showing an early stage of lifting a tab of the first embodiment according to the present invention.

Referring to FIGS. 1 and 2, a first embodiment of a container opening device of the present invention is shown. The device of the present invention comprises a tab 1 including a lifting portion 3 provided on one side and a pressing portion 2 provided on the other side thereof, and fixing means 6, such as a rivet. The rivet 6 is provided at an appropriate portion between the pressing portion 2 and the lifting portion 3, and fixes the tab 1 to a cover or panel 4 of a container, such as a can.

A partially detached or elongated portion 5 extends from the pressing portion 2, and the rivet 6 is fixed to the partially detached portion 5 to fix the tab 1 to the panel 4 of the can. In the partially detached portion 5, a bend-supporting portion 7 is formed, which is located between an edge of the partial detached portion 5 and an edge of the rivet 6. The connecting portion is defined by a substantially U-shaped notch 11. The bend-supporting portion 7 constitutes a supporting point of m theory of a lever when a finger tip engages the lifting portion 3 at the time of opening the cover 4. The lifting portion 3 constitutes a force point of a lever, i.e. tab. The bend-supporting portion 7 is shorter than the pressing portion 2 and constitutes the supporting point or fulcrum of a lever. The pressing portion 2 constitutes an application point. Thus, an effect of a lever is further improved. The device or tab 1 is formed of an aluminum plate.

When a lifting force is applied, the lifting force is separated into a force required for an initial lifting operation of the tab 1 and a force required for opening operation of an opening portion 8 of the cover 4 of the can. In particular, when the opening portion 8 of the cover 4 is opened, a finger tip is inserted into a space between a tip of the lifting portion 3 and the cover 4 to apply a slight force to the lifting portion 3, so that the bend-supporting portion 7 formed on the partially detached portion 5 is gradually bent at fold line 7*a* to orient vertically. Namely, the edge of the partially detached portion 5 and the edge near the rivet 6 are bent to thereby constitute a supporting point Y between the lifting portion 3 and the pressing portion 2. At this time, only the bend-supporting portion 7 formed of the limited aluminum plate in the partially detached portion 5 is bent, so that the initial lifting operation of the tab 1 is completed with an extremely little force. Nevertheless, an enough space for the finger tip is formed between the cover 4 and the lifting portion 3, as shown in FIG. 2.

When the lifting force F is further applied to the lifting portion 3, a theory of a lever acts among the lifting portion 3, the pressing portion 2 and the bend-supporting portion 7. Namely, the lifting force F applied to the lifting portion 3 is supported by the supporting point Y connected to the rivet 6, and transmitted to a portion 10 right under the pressing portion 2 through a tip of the pressing portion 2 to act as an extremely large shearing force X thereon. Therefore, the opening portion 8 surrounded by the score lines 9 can be easily pushed into the can.

Accordingly, by providing the bend-supporting portion 7, the lifting force is separated into the force required for lifting the tab 1 at an early stage and the force required for opening the cover 4. The bend-supporting portion 7 formed of an aluminum plate is only bent from a time that a finger tip engages the tab 1 to a time that an enough space is formed, so that the initial operation for lifting the tab 1 can be carried out with a very little force, and there is no risk of injuring the finger tip or breaking a nail. After the lifting portion 3 is initially pushed upwardly, the finger is fully engaged with the lifting portion 3, and the lifting portion 3 is pulled to open the opening portion 8.

Since a theory of a lever is used, the opening portion of the container can be easily opened, and it is not required to provide a depression or curved portion at the lifting portion. Also, the tab 1 can be easily lifted by a finger numbed with cold, a wet finger, or gloved finger at the time of fishing or skiing to thereby open the opening portion of the can.

As in the conventional container, a depression may be provided on the cover 4, or a curved portion may be formed around a tip portion of the lifting portion 3.

The bend-supporting portion 7 should have a length such that when the tab 1 is initially lifted, a finger tip can enter into a space formed between the surface of the cover 4 and the tab 1, and when the initial lifting operation is completed, the tip of the lifting portion 3 does not project over a flange or a sealed portion 14 in a coil form of the cover 4. Also, in case edges 11 are curved as shown in FIG. 1, no cracks are formed in the vicinity of the edges 11 when the lifting portion is lifted.

Figure 3:
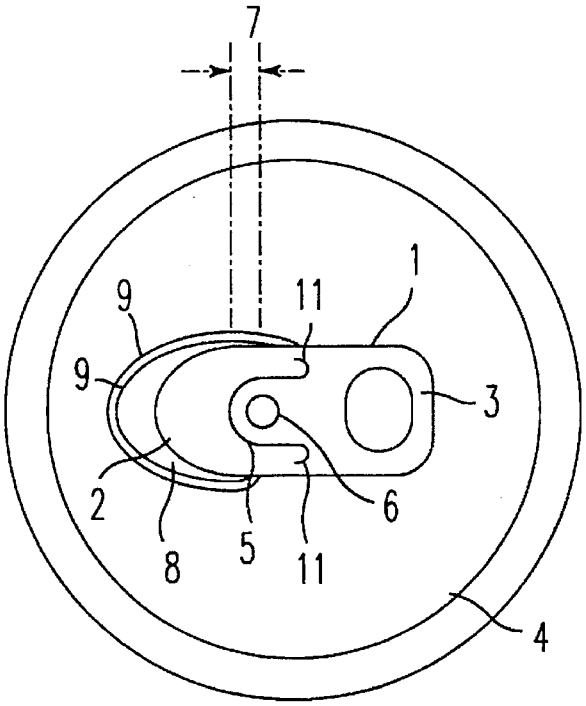
FIG. 3 is a plan view of a second embodiment of a container opening device according to the present invention.

FIG. 3 is a plan view of a second embodiment of the present invention, wherein a tab 1 formed of a sheet of an aluminum plate includes a pressing portion 2 on one side, a lifting portion 3 on the other side thereof, and a bend-supporting portion 7 provided between a rivet 6 and the lifting portion 3 in a partially detached portion 5.

In this case, the pressing portion 2 acts as an application point, the lifting portion 3 constitutes a force point, and the bend-supporting portion 7 constitutes a supporting point in a theory of a lever. Thus, when a finger tip engages the lifting portion 3, only the bend-supporting portion 7 of the tab formed of an aluminum plate is bent to constitute a supporting point of the lever. Thereafter, a pressing force is applied to a portion (tear panel 8) right under the pressing portion 2 of the cover 4. A force is separated into a force required for lifting the tab 1 at an early stage and a force required for opening the cover 4. Further, since a theory of a lever positively acts, the opening portion or tear panel 8 of the cover 4 can be easily opened even with a finger numbed with cold, a wet finger or gloved finger.

Figure 4:
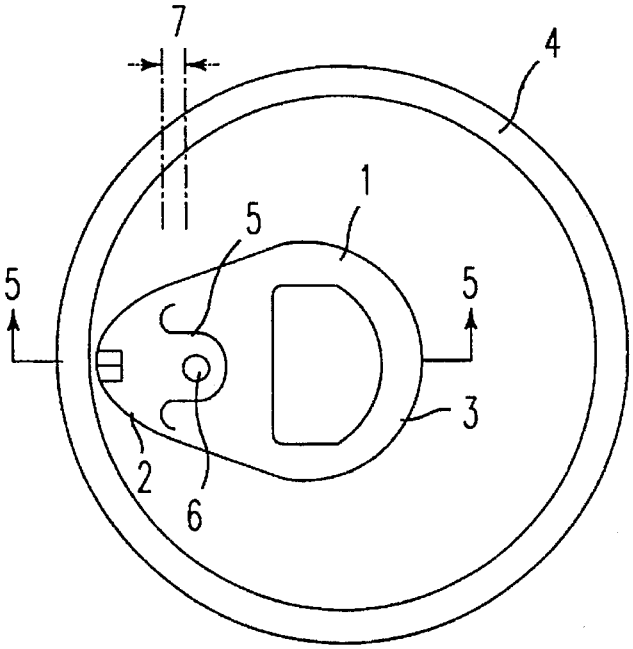
FIG. 4 is a plan view of a third embodiment of a container opening device according to the present invention.
Figure 5:
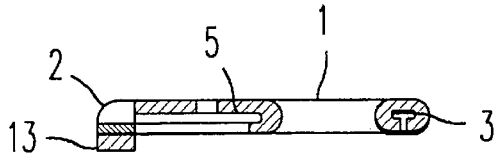
FIG. 5 is a section view taken along a line 5—5 in FIG. 4 for showing a tab of the third embodiment according to the present invention.

FIGS. 4 and 5 are a plan view and a section view showing a third embodiment of a device for lifting a cover of a can according to the present invention. This device 1 is of a full open type, wherein a partially detached portion 5 is provided around a rivet 6, and a bend-supporting portion 7 is formed between a pressing portion 2 and the rivet 6. From an early stage of lifting a tab 1 to completion of opening a cover 4, the bend-supporting portion 7 functions in the same manner as in the first embodiment, and the same effect as in the first embodiment can be obtained.

In this case, if a projection 13 is provided on an edge of the pressing portion 2, a tip portion of the projection 13 is linearly pressed against the surface of the cover 4 to thereby concentrate a pressing force thereon, that is, a force required for opening the cover 4 at the early stage. Thus, the cover of the container can be easily opened.

Figure 6:
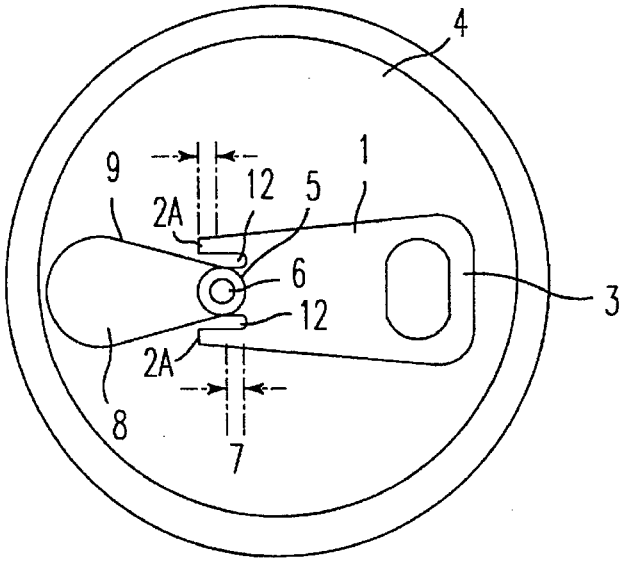
FIG. 6 is a plan view of a fourth embodiment of a container opening device according to the present invention.

FIG. 6 shows a plan view of a fourth embodiment according to the present invention, wherein a bend-supporting portion 7 is provided in a partially detached portion between one edge of a lifting portion 3 and a peripheral edge portion of a rivet 6. In this case, notches 12 are formed on both sides of the bend-supporting portion 7 formed of an aluminum plate. A pressing portion formed of edges 2A is situated outside the notches 12, and the edges 2A slightly project outwardly from a circumferential edge of the rivet 6. In a relationship among the lifting portion 3, edges 2A and the rivet 6, the bend-supporting portion 7 constitutes an application point in a theory of a lever, and the edges 2A constitute supporting points. When an initial lifting operation of the tab 1 is completed, the edge of the lifting portion 3 does not project from a flange or a sealing portion 14 in a coil form.

In this embodiment, the bend-supporting portion 7 is provided between the rivet 6 for fixing an opening portion of the cover 4 to the tab 1 and the lifting portion 3. When the lifting portion 3 is lifted, the edges 2A abut against the cover 4, and at the same time, the bend-supporting portion 7 is bent to constitute an application point. A space is formed between the cover surface 4 and the lifting portion 3. A finger tip can enter into the space.

In this case, since the bend-supporting portion 7 is formed of an aluminum plate, when the tab 1 is lifted at the early stage, the tab 1 can be safely lifted with a little lifting force, in the same manner as in the first embodiment.

Further, when the lifting portion 3 is lifted, since the notch edges 2A are longer than the bend-supporting portion 7, a theory of a lever is held such that the bend-supporting portion 7 functions as an application point of a lever, the lifting portion 3 constitutes a force point, and the notch edges 2A constitute a supporting point. The rivet 6 connects the tab 1 to the cover 4. Thus, a lifting force F applied to the lifting portion 3 is transmitted to an opening portion 8 of the cover 4 through the rivet 6 as a large opening force, and the opening portion 8 can be opened with a very little force. The device of the present invention can be used as a pulling tab.

Figure 7:
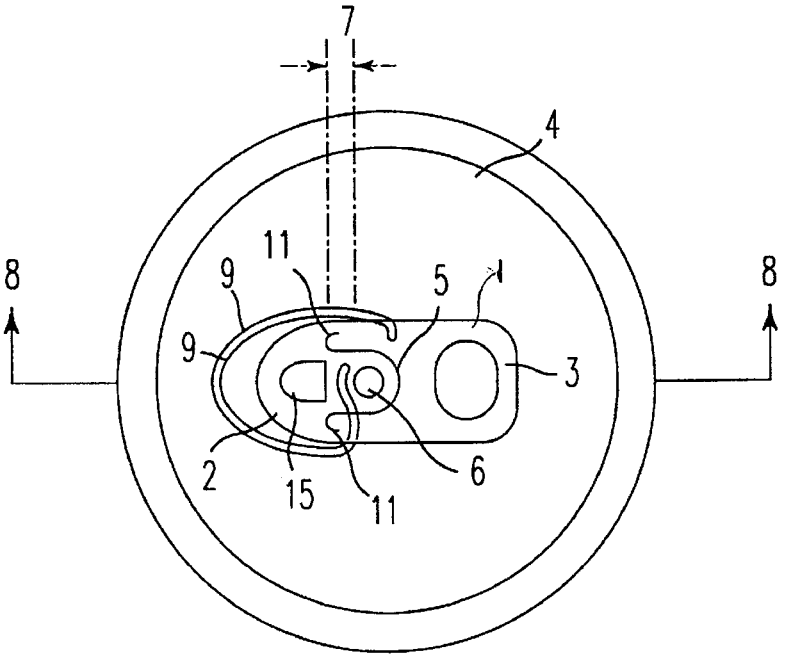
FIG. 7 is a plan view of a fifth embodiment of a container opening device according to the present invention.
Figure 7A:
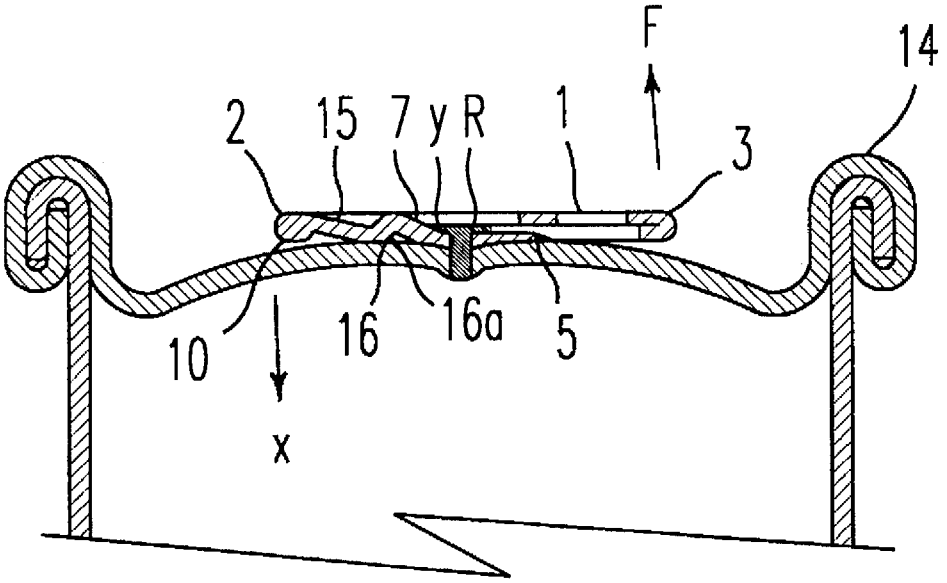
FIG. 7*a* is a sectional view of FIG. 7 showing the tab before any force is applied.

FIG. 7 is a plan view showing a fifth embodiment of the present invention, wherein a projection 15 projecting toward a cover 4 is provided in a pressing portion 2 near an edge portion of a bend-supporting portion 7. The projection 15 has a triangular cross section and extends substantially to the same level as the cover 4. A side near the bend-supporting portion 7 extends perpendicularly to the outer surface of the pressing portion. The edge portions 11 and an edge portion of the projection 15 are spaced for a distance so that the bend-supporting portion 7 can be bent. FIG. 7*a* shows this embodiment before any force is applied to the tab 1.

Figure 8:
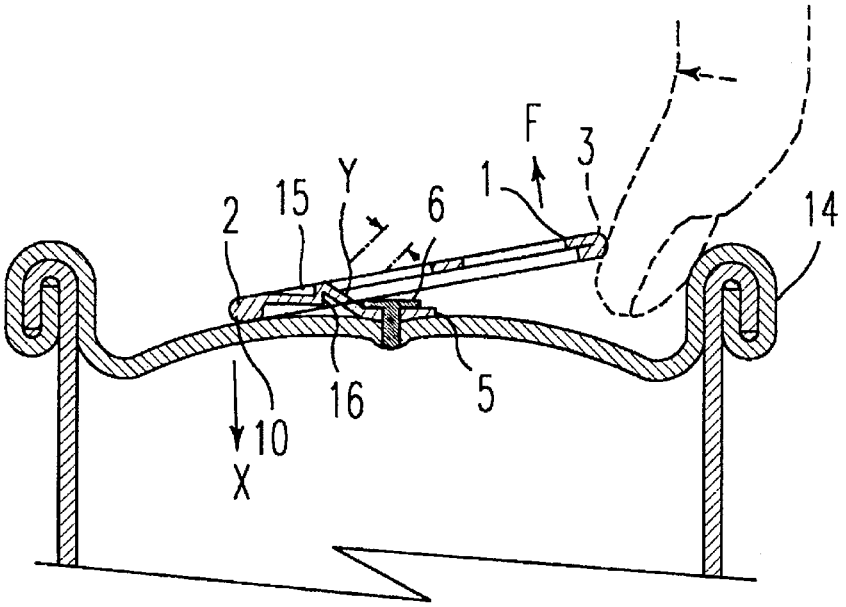
FIG. 8 is a section view taken along a line 8—8 in FIG. 7 for showing an early stage of lifting the cover of the can of the fifth embodiment of the present invention.
Figure 9:
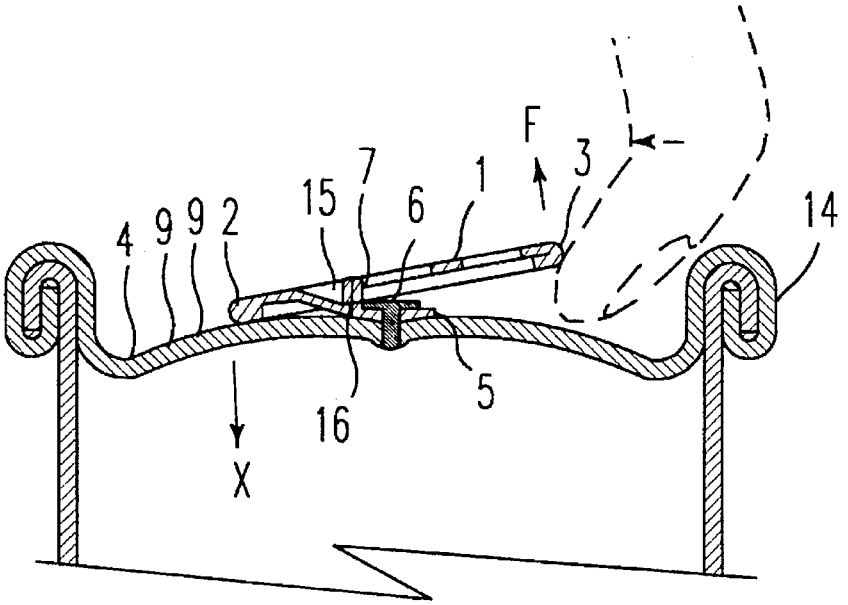
FIG. 9 is a section view taken along the line 8—8 in FIG. 7 for showing that the device is going to shear the cover in the fifth embodiment according to the present invention.

As shown in FIGS. 8 and 9, when a finger tip engages the lifting portion 3, the bend-supporting portion 7 of the tab 1 is slightly raised, and at the same time, the pressing portion 2 is drawn toward the rivet 6 so that a surface 16 of the projection 15 closely abuts against a surface of the bend-supporting portion 7 to support and function as a reinforcing member. Therefore, the opening portion of the cover 4 can be stably opened, and the aluminum plate for constituting the tab 1 is formed very thin to thereby reduce a cost of the material as well as a lifting force of the tab 1.

Figure 10:
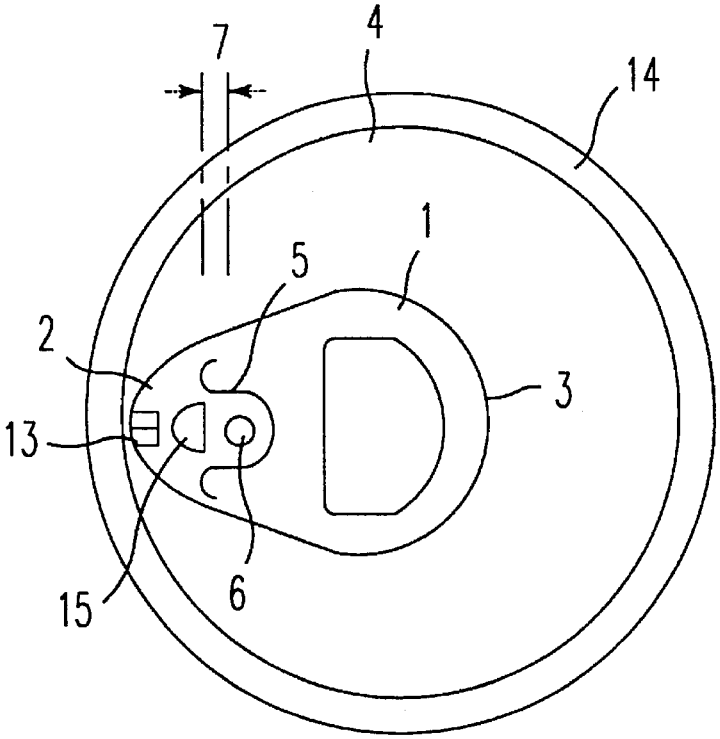
FIG. 10 is a plan view of a sixth embodiment of a container opening device according to the present invention.

FIG. 10 is a plan view for showing a sixth embodiment of the present invention, wherein a tab 1 of the invention is of a full open type, and is provided with a projection 15 as in the fifth embodiment. In the embodiment, the same function and effect can be obtained as in the fifth embodiment.

Figure 11:
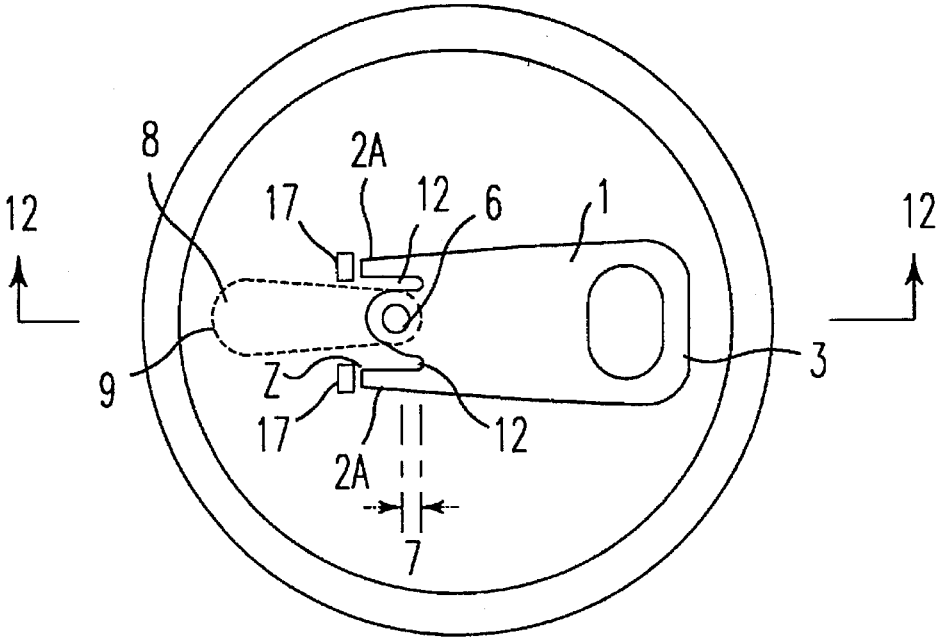
FIG. 11 is a plan view of a seventh embodiment of a container opening device according to the present invention.
Figure 12:
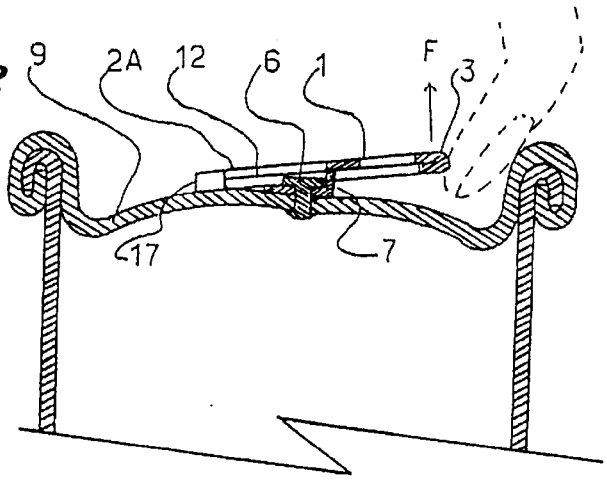
FIG. 12 is a section view taken along a line 12—12 in FIG. 11 for showing an early stage of lifting tab of the seventh embodiment according to the present invention.
Figure 13:
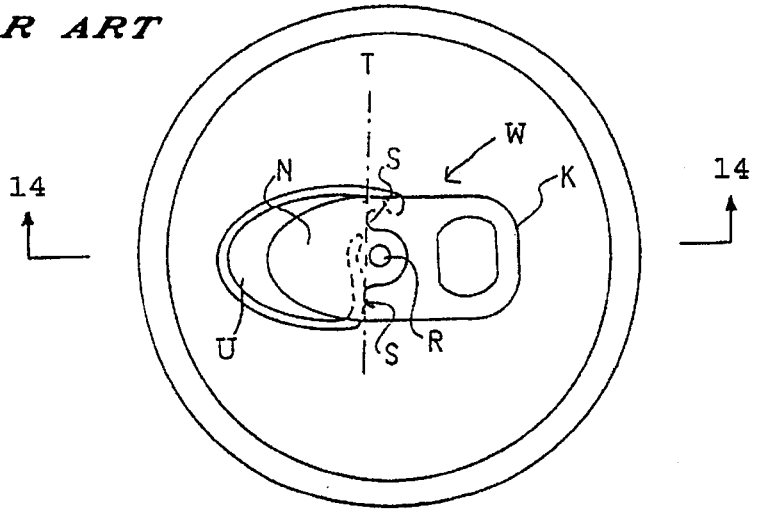
FIG. 13 PRIOR ART
FIG. 13 is a plan view for showing a conventional container opening device.
Figure 14A:
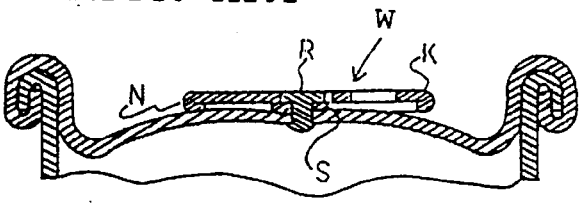
FIG. 14a PRIOR ART
FIGS. 14(*a*) and 14(*b*) are section views for showing stages of lifting a tab of the conventional device shown in FIG. 13.
Figure 14B:
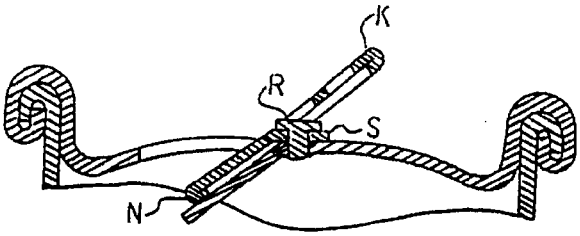
FIG. 14b PRIOR ART

FIG. 11 is a plan view of a seventh embodiment of the present invention, and FIG. 12 is a section view thereof for showing a lifting state of a tab 1 at an early stage. In the tab 1 for opening a can by shearing an opening portion 8 of a cover 4, a plurality of projections 17 for suppressing movements of notch edges 2A is provided on the surface of a cover 4 with a slight distance Z away from the respective notch edges 2A. In a lever relationship, a lifting portion 3 constitutes a force point, a bend-supporting portion 7 functions as an application point, and the notch edges 2A constitute a supporting point.

When the lifting portion 3 is lifted as shown in FIG. 12, tip portions of the notch edges 2A are slightly moved toward the projections 17, 17 and abut against the same to suppress the movement of the notch edges 2A, so that the notch edges 2A stably function as supporting points of a lever. Since the theory of the lever positively works in the device, the notch edges 2A as the supporting point are stably positioned, and the cover 4 starts opening along an engraved score line 9 provided on the cover 4 from the peripheral portion of the rivet 6 to complete an initial opening with a very little force.

As has been described hereinabove, in the present invention, since a bend-supporting portion is provided to a tab, when the tab is lifted at an early stage, only the bend-supporting portion of the tab formed of an aluminum plate is bent, and an initial lifting operation can be easily carried out with a very little force.

Therefore, the present invention can provide a safe device for opening a can with a little force, wherein a finger tip is not insured nor a nail is broken. Also, since the bend-supporting portion is bent so as to function as a supporting point of a lever, a pressing force applied to the cover of the can is greatly increased when compared with a force applied to a lifting portion. Thus, with a very little lifting force, the cover of the container can be easily opened along an engraved score line of the cover 4 even with a finger numbed with cold, a wet finger, or gloved finger.

While the invention has been explained with reference to the specific embodiments of the invention, the explanation is illustrative, and the invention is limited only by the appended claims.

What is claimed is:

1. A device for opening an opening portion of an upper panel of a container, the device comprising:

a pull tab being in contact with said upper panel in a storage position, said pull tab including a lifting portion, said lifting portion being located on a first side of the pull tab;

a pressing portion integrally formed with the lifting portion on a second side of said pull tab;

an elongated portion extending from said pressing portion toward said lifting portion;

a fixing member for fixing a part of the elongated portion to the upper panel of the container; and a bend-supporting portion provided in the elongated portion between the fixing member and an edge near said pressing portion, said bend-supporting portion initially receiving a lifting force and bending upwardly thereat when the lifting portion is initially pulled to provide a space for a finger between the upper panel and the lifting portion, said bend-supporting portion thereafter serving as a fulcrum and enlarging said lifting force so as to transmit the lifting force to the pressing portion which presses against said upper panel to rupture said opening portion or said upper panel;

wherein a projection is provided on said pressing portion so as to project downwardly at a position near a fold line of the elongated portion, the projection being brought to contact with a rear surface of said bend-supporting portion when said bend-supporting portion is bent at an early stage of lifting operating of said pull tab.

2. A device according to claim 1, wherein said pressing portion includes a depression near the bend-supporting portion to reinforce the pressing portion.

3. A device according to claim 1, wherein said pressing portion includes a projection at a side facing the opening portion to concentrate opening force thereat.

* * * * *